US009063477B2

(12) United States Patent
Michishita et al.

(10) Patent No.: US 9,063,477 B2
(45) Date of Patent: Jun. 23, 2015

(54) IMAGE FORMING APPARATUS

(71) Applicant: KYOCERA Document Solutions Inc., Osaka (JP)

(72) Inventors: Yasuhiro Michishita, Osaka (JP); Satoshi Uemura, Osaka (JP); Koji Uno, Osaka (JP); Tetsuya Toichi, Osaka (JP); Masafumi Hashimura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/522,495

(22) Filed: Oct. 23, 2014

(65) Prior Publication Data

US 2015/0117876 A1 Apr. 30, 2015

(30) Foreign Application Priority Data

Oct. 31, 2013 (JP) ..... 2013-227766

(51) Int. Cl.
*G03G 15/00* (2006.01)
*G03G 15/16* (2006.01)

(52) U.S. Cl.
CPC ..... *G03G 15/168* (2013.01)

(58) Field of Classification Search
CPC G03G 15/168; G03G 15/553; G03G 15/1695
USPC ..... 399/24, 94, 101, 313, 390, 400
See application file for complete search history.

(56) References Cited

U.S. PATENT DOCUMENTS 5,822,666 A * 10/1998 Haneda et al. ..... 399/309
6,308,040 B1 * 10/2001 Mizuno ..... 399/388

FOREIGN PATENT DOCUMENTS

JP 2002-031960 1/2002

* cited by examiner

*Primary Examiner* — Hoang Ngo
(74) *Attorney, Agent, or Firm* — Knobbe, Martens, Olson & Bear LLP

(57) ABSTRACT

An image forming apparatus includes: a photosensitive drum; a transfer belt configured to be charged to an opposite polarity to the surface of the photosensitive drum to electrostatically attract a recording paper sheet and convey the sheet while pressing the sheet against the photosensitive drum, thereby transferring a toner image formed on the surface of the photosensitive drum to the sheet; a fixing section configured to apply heat to the recording paper sheet having the toner image transferred thereto and thus fix the toner image on the sheet; a toner collecting member disposed to face a separating position where the recording paper sheet is separated from the transfer belt and extending in a width direction of the sheet being conveyed, the toner collecting member being electrically grounded; and a thermally conductive member configured to collect heat near the fixing section and conduct the collected heat to the toner collecting member.

5 Claims, 7 Drawing Sheets

Fig.6

| | UNWANTED SPOTS ON IMAGE | | | JAM | | |
|---|---|---|---|---|---|---|
| | ~600K | 600K~ | 700K~ | ~600K | 600K~ | 700K~ |
| 50-G SHEET | ○ | ○ | ***<br>(UNWANTED SPOTS ON IMAGE) | ○ | ○ | ×<br>SHEET IS CAUGHT ON ICICLE-LIKE TONER DEPOSIT AND FAILS TO PASS OVER IT |
| 64-G SHEET | ○ | ○ | ○ | ○ | ○ | ○ |
| 200-G SHEET | ○ | ○ | △<br>RUBBING OFF OF TONER ON TRAILING END | ○ | ○ | ○ |

IMAGE FORMING APPARATUS

INCORPORATION BY REFERENCE

This application claims priority to Japanese Patent Application No. 2013-227766 filed on Oct. 31, 2013, the entire contents of which are incorporated by reference herein.

BACKGROUND

The present disclosure relates to image forming apparatuses and particularly relates to a technique for improving image quality and preventing toner scattering in an image forming apparatus of a transfer belt type.

Electrophotographic image forming apparatuses, such as a multifunction peripheral, a printer, a copier, and a facsimile device, include those of a transfer belt type in which an endlessly traveling dielectric belt is used to convey a recording paper sheet and transfer a toner image to the recording paper sheet. The image forming apparatus of the transfer belt type is configured to induce electric charges on the surface of the transfer belt to electrostatically attract a recording paper sheet to the transfer belt, convey it in this state, and allow a toner image formed on the surface of a photosensitive drum to be transferred to the recording paper sheet.

The image forming apparatus of the transfer belt type is advantageous in terms of separability of the recording paper sheet from the photosensitive drum (image carrier), stability of sheet conveyance, and image transferability. However, the image forming apparatus of this type may cause separation discharge upon curvature-induced separation of the recording paper sheet from the downstream end of the transfer belt, so that toner on the surface of the recording paper sheet may scatter, resulting in a problem of the occurrence of an image defect (electrostatically toner-scattered image) and a problem in that scattered toner is accumulated in the apparatus to contaminate the apparatus interior. Furthermore, the recording paper sheet is strongly charged to the same polarity as the toner, which presents a problem of the occurrence of electrostatic offset in the fixing process.

As a solution to the above problems, a technique is known in which a high-resistance, sheet-shaped transfer exit guide plate is provided downstream of the transfer belt in the direction of conveyance of the recording paper sheet to eliminate the static electricity of the recording paper sheet separated by curvature from the transfer belt using the guide plate and thus prevent separation discharge of the recording paper sheet.

SUMMARY

A technique improved over the above technique is proposed as one aspect of the present disclosure.

An image forming apparatus according to the one aspect of the present disclosure includes a photosensitive drum, a transfer belt, a fixing section, a toner collecting member, and a thermally conductive member.

The photosensitive drum has a surface on which a toner image is to be formed.

The transfer belt is configured to be charged to an opposite polarity to the surface of the photosensitive drum to electrostatically attract a recording paper sheet and convey the recording paper sheet while pressing the recording paper sheet against the photosensitive drum, thereby transferring the toner image formed on the surface of the photosensitive drum to the recording paper sheet.

The fixing section is configured to apply heat to the recording paper sheet having the toner image transferred thereto and thus fix the toner image on the recording paper sheet.

The toner collecting member is disposed to face a separating position where the recording paper sheet is separated from the transfer belt, extends in a width direction of the recording paper sheet being conveyed, and is electrically grounded.

The thermally conductive member is configured to collect heat near the fixing section and conduct the collected heat to the toner collecting member.

BRIEF DESCRIPTION OF THE DRAWINGS

FIG. 6 is a table showing the occurrence/absence of unwanted toner spots on the image and the occurrence/absence of paper jam for different numbers of recording paper sheets fed through the image forming apparatus in different cases where different types of recording paper sheets are fed through the image forming apparatus.

DETAILED DESCRIPTION

Figure 1:
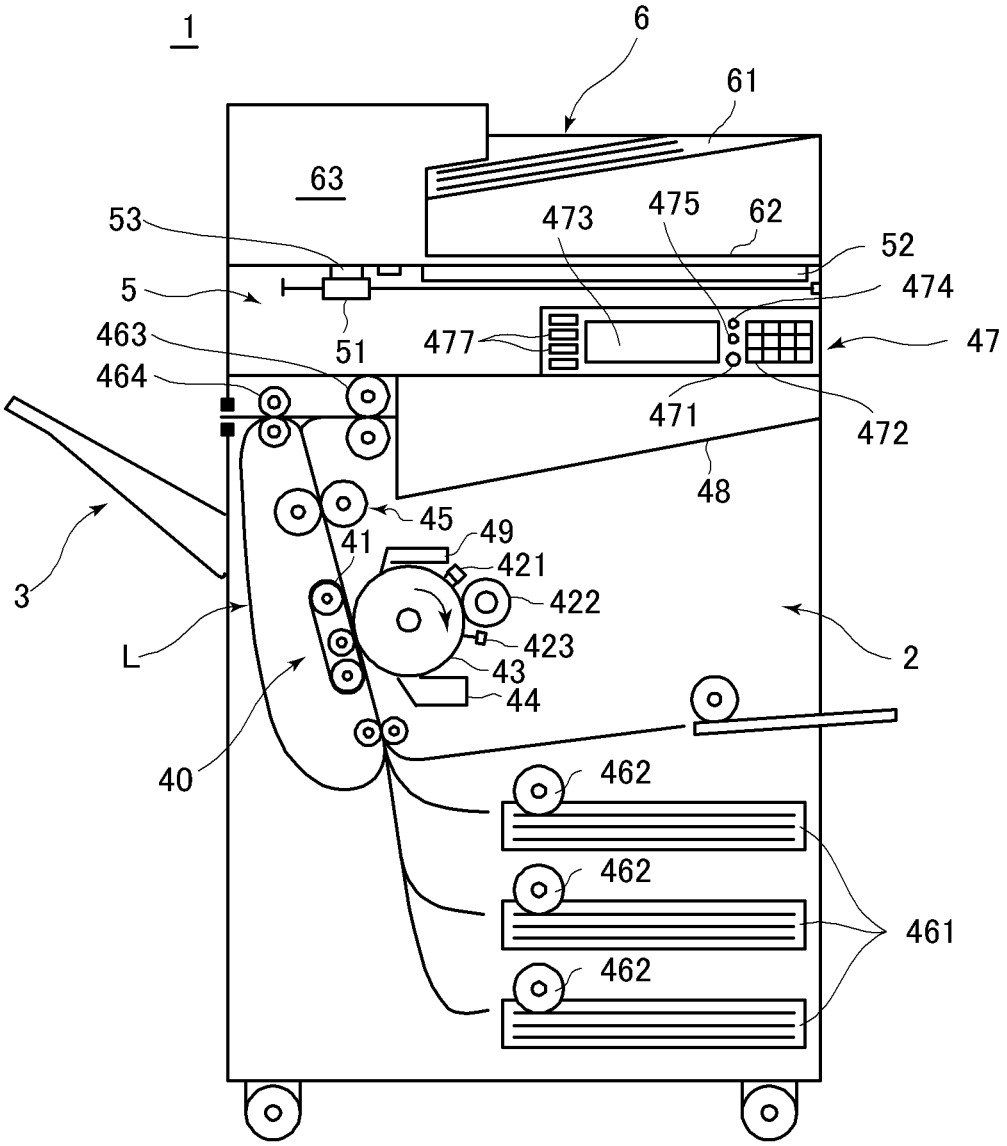
FIG. 1 is a front cross-sectional view showing the structure of an image forming apparatus according to one embodiment of the present disclosure.

Hereinafter, a description will be given of an image forming apparatus according to one embodiment of the present disclosure with reference to the drawings. FIG. 1 is a front cross-sectional view showing the structure of an image forming apparatus 1 according to one embodiment of the present disclosure.

The image forming apparatus 1 is a multifunction peripheral having multiple functions including, for example, a copy function, a print function, a scan function, and a facsimile function. The image forming apparatus 1 includes a main body 2, a stacking tray 3 disposed on the left of the main body 2, an image reading section 5 disposed on the top of the main body 2, and a document feed section 6 disposed on the top of the image reading section 5.

Furthermore, an operating section 47 is provided in a front portion of the image forming apparatus 1. The operating section 47 is equipped with a start key 471, a ten-key pad 472, a display 473, a reset key 474, a stop key 475, and function selection keys 477. The start key 471 is a key through which the user enters commands to execute various functions executable by the image forming apparatus 1. The ten-key pad 472 is a set of keys through which the user inputs conditions for executing each function, such as the number of copies. The display 473 is formed of a liquid crystal display or the like, can display various screens, including respective setting screens for use in inputting conditions for executing the respective functions, and has a function as a touch panel through which the user inputs the various settings. The reset key 474 is a key for resetting the settings and so on set on the display 473. The stop key 475 is a key for stopping the function being executed. The function selection keys 477 are keys for switching among a copy function, a print function, a scan function, and a facsimile function.

The display 473 is configured to display not only an operating screen including operating buttons for the touch panel function but also a preview of image data generated by the image reading section 5.

The image reading section 5 includes: a scanner section 51 composed of a CCD (charge coupled device) sensor, an exposure lamp, and so on; an original glass plate 52 made of a transparent material, such as glass; and a document read slit 53.

The scanner section 51 is movable by an unshown drive section. In reading an original document set on the original glass plate 52, the scanner section 51 is moved along the surface of the original document while facing the original glass plate 52, scans an image of the original document, and concurrently outputs image data acquired by the scanning to a control unit 10 (see FIG. 3) to be described hereinafter. On the other hand, in reading an original document fed from the document feed section 6, the scanner section 51 is moved to a position facing the document read slit 53, acquires an image of the original document through the document read slit 53 in synchronism with the document conveyance of the document feed section 6, and outputs the acquired image data to the control unit 10.

The document feed section 6 includes a document table 61 on which original documents are to be placed, a document ejection portion 62 on which already read original documents are to be ejected, and a document conveyance mechanism 63 composed of a document feed roller (not shown), a conveyance roller (not shown), and so on and configured to feed the original documents placed on the document table 61 sheet by sheet, convey the document sheet to the position facing the document read slit 53, and eject it to the document ejection portion 62.

The document conveyance mechanism 63 further includes a sheet reversing mechanism (not shown) configured to reverse the side of the original document and convey the document to the position facing the document read slit 53 again. Thus, images on both sides of the original document can be read through the document read slit 53 by the scanner section 51.

Furthermore, the document feed section 6 is pivotally mounted to the main body 2 so that its front side can move upward. When the front side of the document feed section 6 is moved up to make the top surface of the original glass plate 52 open, the user can place, on the top surface of the original glass plate 52, an original document to be read, for example, an open book with facing pages.

The main body 2 contains a plurality of sheet feed cassettes 461, a plurality of sheet feed rollers 462 configured to feed recording paper sheets sheet by sheet from their respective associated sheet feed cassettes 461 and convey the recording paper sheet to an image forming section 40, and the image forming section 40 configured to form an image on each of the recording paper sheets P conveyed from the sheet feed cassettes 461.

The image forming section 40 includes: a photosensitive drum 43 as an image carrier having an organic photoconductive (OPC) layer formed on its surface; a cleaning unit 49 configured to remove residual toner on the photosensitive drum 43; a static eliminating section 421 configured to eliminate residual electric charge on the surface of the photosensitive drum 43; a charging roller 422 configured to charge the surface of the photosensitive drum 43 having been subjected to the static elimination; an exposure section 423 configured to, based on image data acquired by the scanner section 51, output laser light to expose the surface of the photosensitive drum 43 to the laser light and thus form an electrostatic latent image on the surface of the photosensitive drum 43; a development section 44 configured to form a toner image on the photosensitive drum 43 based on the electrostatic latent image; a transfer belt 41 configured to nip a recording paper sheet with the photosensitive drum 43 and transfer the toner image carried on the photosensitive drum 43 to the recording paper sheet; a fixing section 45 configured to apply heat to the recording paper sheet having the toner image transferred thereto to fix the toner image on the recording paper sheet; and pairs of conveyance rollers 463, 464 provided in a paper conveyance path in the image forming section 40 and configured to convey the recording paper sheet to the stacking tray 3 or a paper output tray 48.

In forming images on both sides of a recording paper sheet, an image is first formed on one side of the recording paper sheet by the image forming section 40 and the recording paper sheet is then nipped between the pair of conveyance rollers 463 located near the paper output tray 48. In this state, the pair of conveyance rollers 463 are reversed to move the recording paper sheet to a paper conveyance path L, the recording paper sheet is conveyed again to upstream of the image forming section 40, an image is formed on the other side of the recording paper sheet by the image forming section 40, and the recording paper sheet is then discharged to the stacking tray 3 or the paper output tray 48.

Figure 2:
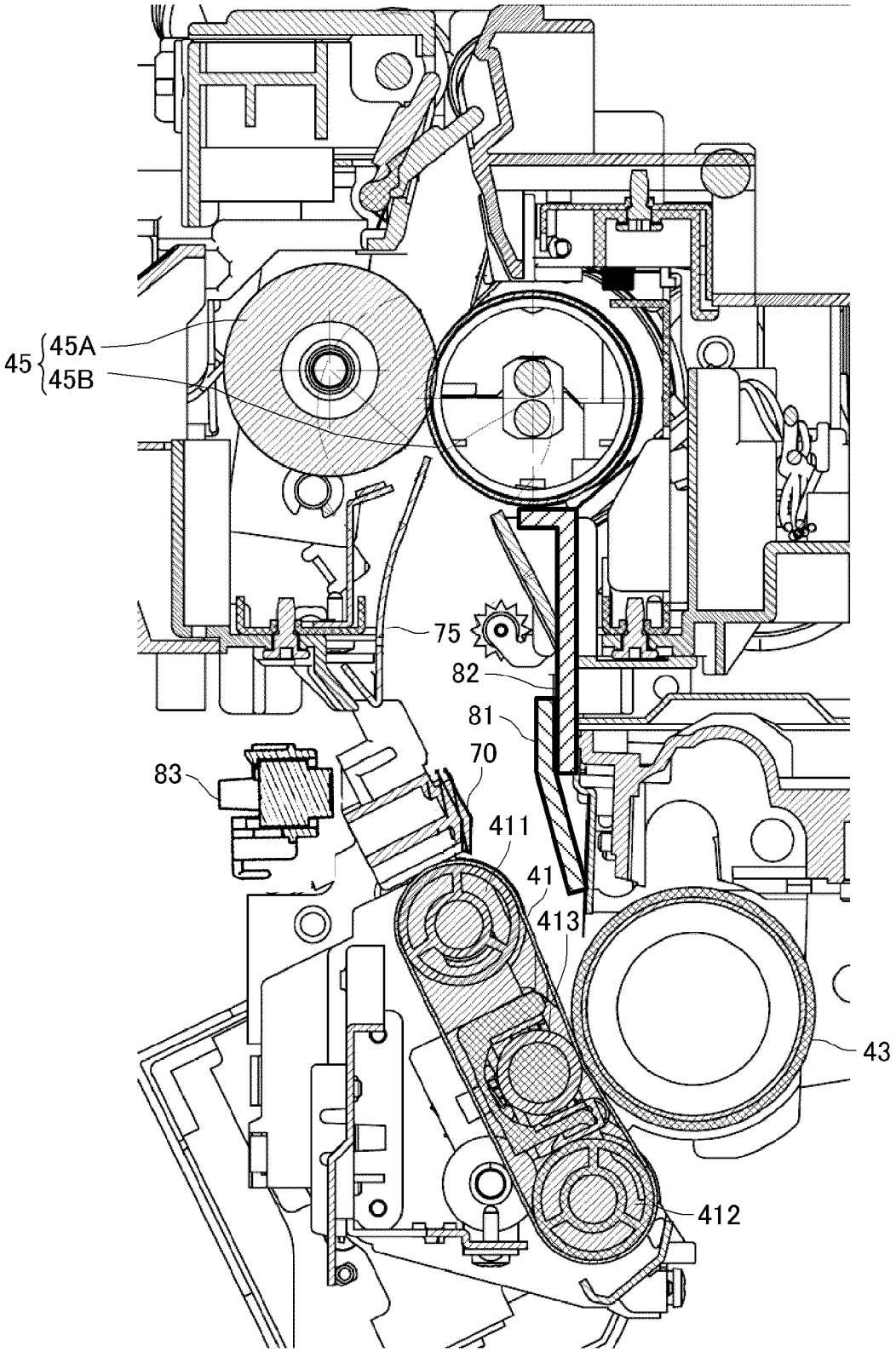
FIG. 2 is a detailed front cross-sectional view of a portion from a transfer belt to a fixing section in FIG. 1.

FIG. 2 is a detailed front cross-sectional view of a portion from the transfer belt 41 to the fixing section 45 in FIG. 1. The transfer belt 41 is a belt mounted around a drive roller 411 and a driven roller 412 and capable of endlessly traveling between them. A transfer roller 413 is pressed toward the photosensitive drum 43 at a predetermined pressure with the transfer belt 41 in between by an unshown compression spring.

The transfer roller 413 is connected to an unshown high-voltage power supply section. When the high-voltage power supply section applies a predetermined transfer bias voltage to the transfer roller 413, a toner image formed on the surface of the photosensitive drum 43 is transferred to the recording paper sheet at the nip between the photosensitive drum 43 and the transfer roller 413.

The above transfer bias voltage from the high-voltage power supply section is also applied to the transfer belt 41 through the transfer roller 413, so that the recording paper sheet P is electrostatically attracted to the transfer belt 41. Specifically, the transfer belt 41 is charged to an opposite polarity to the surface of the photosensitive drum 43 to electrostatically attract the recording paper sheet and conveys the recording paper sheet while pressing it against the photosensitive drum 43, thereby transferring the toner image formed on the surface of the photosensitive drum 43 to the recording paper sheet.

The recording paper sheet electrostatically attracted onto the transfer belt 41 is separated from the transfer belt 41 at the downstream end of the transfer belt 41 by the curvature of the drive roller 411. Therefore, a position where the transfer belt 41 and the drive roller 411 starts to make contact with each other is the position where the recording paper sheet comes unstuck (separates) from the transfer belt 41 (a separating position).

A post-transfer guide 70 is disposed downstream of the transfer belt 41 in the direction of conveyance. The post-transfer guide 70 is a member configured to support the recording paper sheet, which has been separated by curvature from the downstream end of the transfer belt 41, from the back surface of the recording paper sheet opposite to the surface having the toner image transferred thereto and guide it to the fixing section 45. A high-resistance sheet is provided on the surface of the post-transfer guide 70. The sheet eliminates the static electricity of the recording paper sheet having been separated by curvature from the transfer belt 41 and thus prevents separation discharge of the recording paper sheet.

Furthermore, a pro-fixing guide 75 is disposed downstream of the post-transfer guide 70. The recording paper sheet having been separated from the transfer belt 41 is guided to the post-transfer guide 70 and the pro-fixing guide 75 and then conveyed to the fixing section 45.

The fixing section 45 includes a pressure roller 45A and a heat roller 45B. The toner image transferred to the surface of the recording paper sheet is fixed on the recording paper sheet at the nip between the pressure roller 45A and the heat roller 45B.

A toner collecting member 81 is disposed facing the separating position at which the recording paper sheet is separated from the transfer belt 41. The toner collecting member 81 is formed of a material having excellent electrical conductivity, for example, a SECC (electrogalvanized steel plate), and extends transversely to the direction of conveyance of the recording paper sheet. The toner collecting member 81 is electrically grounded.

Furthermore, the toner collecting member 81 is removable from the main body 2. The image forming apparatus 1 has a cover at a side surface thereof and is configured so that the nip between the photosensitive drum 43 and the transfer roller 413 and the nip between the pressure roller 45A and the heat roller 45B are released in conjunction with the opening of the cover. Therefore, when the cover is opened, the toner collecting member 81 can be exposed to the outside and replaced with a new one.

A thermally conductive member 82 is disposed near the fixing section 45, more particularly, near the heat roller 45B. The thermally conductive member 82 is formed of a material having excellent thermal conductivity, for example, aluminum, and extends in the width direction of the heat roller 45B.

A portion of the thermally conductive member 82 is in contact with the toner collecting member 81. For example, an end portion of the thermally conductive member 82 extending in the width direction of the heat roller 45B is extended to the toner collecting member 81, so that a portion of the thermally conductive member 82 can be brought into contact with the toner collecting member 81. FIG. 2 shows a section through such a contact region between the thermally conductive member 82 and the toner collecting member 81. When in this manner the portion of the thermally conductive member 82 is in contact with the toner collecting member 81, heat collected near the fixing section 45 by the thermally conductive member 82 can be conducted to the toner collecting member 81.

In this embodiment, the heat roller 45B is shown as employing an IH (electromagnetic induction heating) method. In the case where the heat roller 45B is heated by the IH method, a portion of the thermally conductive member 82 located near the fixing section 45, more particularly, a portion thereof near the heat roller 45B, may be formed of a material containing a magnetic material. Thus, the magnetic material can produce heat by the effect of lines of magnetic force present near the heat roller 45B and conduct the produced heat to the toner collecting member 81.

Upon separation of the recording paper sheet from the transfer belt 41, positively charged toner scatters. Since in this embodiment the toner collecting member 81 is electrically grounded, the scattered positively-charged toner is electrically attracted to the toner collecting member 81. Furthermore, in the case where the fixing section 45 is heated to approximately 200° C. by the application of heat from the heat roller 45B, the toner collecting member 81 is heated to approximately 60 to 70° C. by the conduction of heat from the thermally conductive member 82. If in this case the toner used is, for example, one having a glass transition point (Tg) of 52° C., the toner collecting member 81 will be heated above the glass transition point of the toner during the operation of the fixing section 45. In order that the toner collecting member 81 can be heated above the glass transition point of the toner in this manner, the toner collecting member 81 and the thermally conductive member 82 are selected in material, size, location, and so on. Thus, the toner electrically attracted to the toner collecting member 81 can be fixed on the surface of the toner collecting member 81. This prevents contamination of recording paper sheets due to the falling of toner scattered in and deposited on the interior of the image forming apparatus.

If the toner collecting member 81 continues to be used without replacement, the toner fixed on the surface thereof may gradually pile up to cause a paper jam or rubbing off of toner on the printed image. To cope with this and detect the bulk (thickness) of toner fixed on the surface of the toner collecting member 81, a distance sensor 83 is provided opposite to the toner collecting member 81.

The distance sensor 83 includes unshown light-emitting part and light-receiving part. The light-emitting part emits light toward an object (the surface of the toner collecting member 81 in this case) and the light-receiving part receives light reflected from the object. Thus, the distance sensor 83 detects the distance from a reference position to the object in a non-contact manner.

Figure 3:
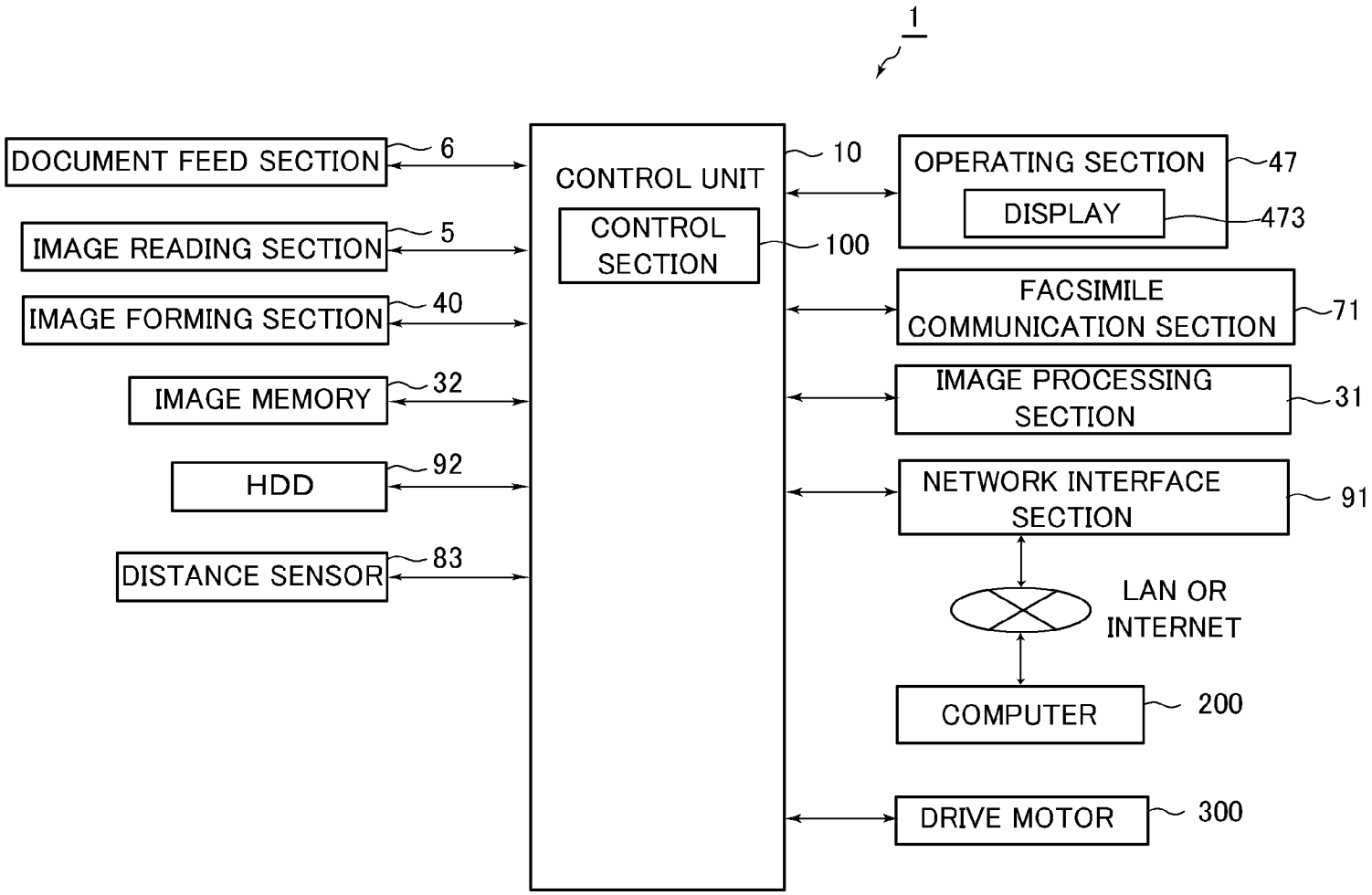
FIG. 3 is a functional block diagram schematically showing an essential internal architecture of the image forming apparatus.

Next, a description will be given of the structure of the image forming apparatus 1. FIG. 3 is a functional block diagram showing an essential internal architecture of the image forming apparatus 1.

The image forming apparatus 1 includes the aforementioned control unit 10. The control unit 10 is composed of a CPU (central processing unit), a RAM, a ROM, a dedicated hardware circuit, and so on and governs the overall operation control of the image forming apparatus 1.

The image reading section 5 is under the control of the control unit 10 and includes the above scanner section 51 including the CCD sensor, the exposure lamp, and so on. The image reading section 5 is configured to read an image from an original document by applying light to the original document with the exposure lamp and receiving, at the CCD sensor, reflected light from the original document.

An image processing section 31, if necessary, processes image data of the image read by the image reading section 5. For example, in order that the image read by the image reading section 5 is improved in quality after the formation of an image in the image forming section 40, the image processing section 31 performs predetermined image processing, such as shading correction.

An image memory 32 provides a region for temporarily storing data of image of the original document read by the image reading section 5 and temporarily storing data to be printed by the image forming section 40.

The image forming section 40 is configured to form an image of print data read by the image reading section 5, an image of print data received from a network-connected computer 200, or the like.

The operating section 47 is configured to receive operator's commands for various types of operations and processing executable by the image forming apparatus 1. The operating section 47 includes the aforementioned display 473.

A facsimile communication section 71 includes a coding/decoding section, a modulation/demodulation section, and an NCU (network control unit), all of which are not illustrated, and performs facsimile communication using a public telephone network.

A network interface section 91 is constituted by a communication module, such as a LAN board, and configured to transfer various data to and from computers 200 and the like in a local area via a LAN or the like connected to the network interface section 91.

An HDD (hard disk drive) 92 is a large storage device capable of storing document images and the like read by the image reading section 5.

The distance sensor 83 is configured to detect the distance from the reference position to the surface of the toner collecting member 81.

A drive motor 300 is a drive source for applying a rotary drive force to various rotary members of the image forming section 40, such as the photosensitive drum 43, and various rotary members of the fixing section 45.

The control unit 10 includes a control section 100. The control section 100 is connected to the image reading section 5, the document feed section 6, the image processing section 31, the image memory 32, the image forming section 40, the operating section 47, the facsimile communication section 71, the network interface section 91, the HDD 92, the distance sensor 83, and so on and controls the operations of these components.

Furthermore, the control section 100 is configured to determine whether or not the time to replace the toner collecting member 81 has come according to the distance detected by the distance sensor 83. When determining that the time to replace has come, the control section 100 allows the display 473 to display a predetermined indication of the need to replace the toner collecting member 81. In this case, the display 473 serves as a notifying section for notifying the user of a message that the toner collecting member 81 should be replaced.

Figure 4:
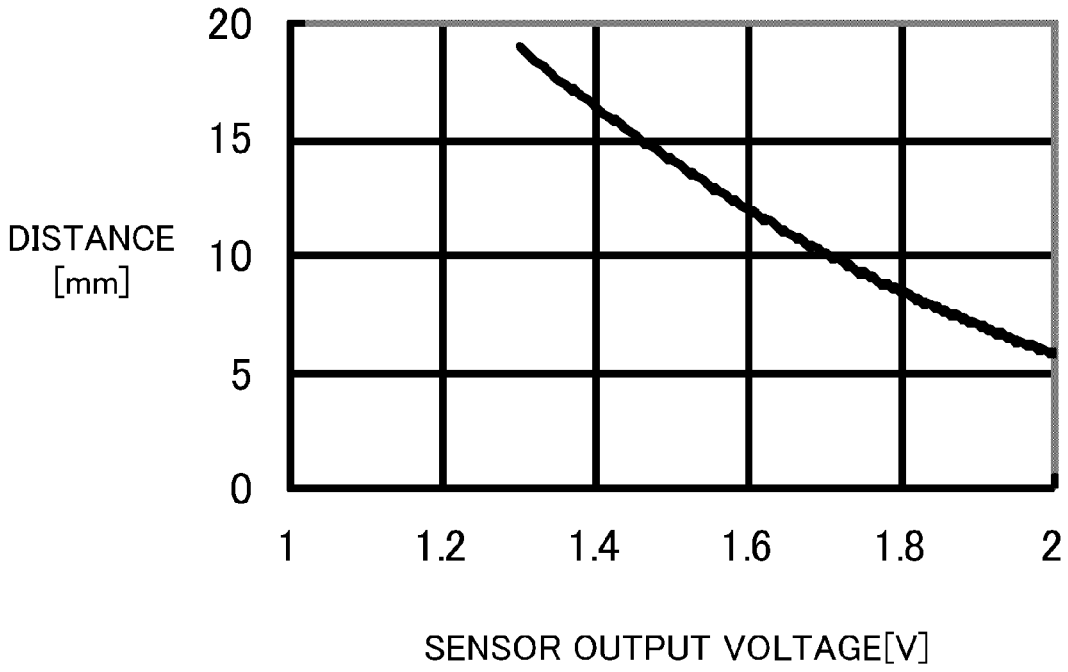
FIG. 4 is a graph showing the relationship between the output voltage of a distance sensor and the distance detected by the distance sensor.

FIG. 4 shows the relationship between the output voltage of the distance sensor 83 and the detected distance in the image forming apparatus 1. As seen from FIG. 4, the higher the output voltage of the distance sensor 83, the shorter the distance from the reference position to the object.

Figure 5:
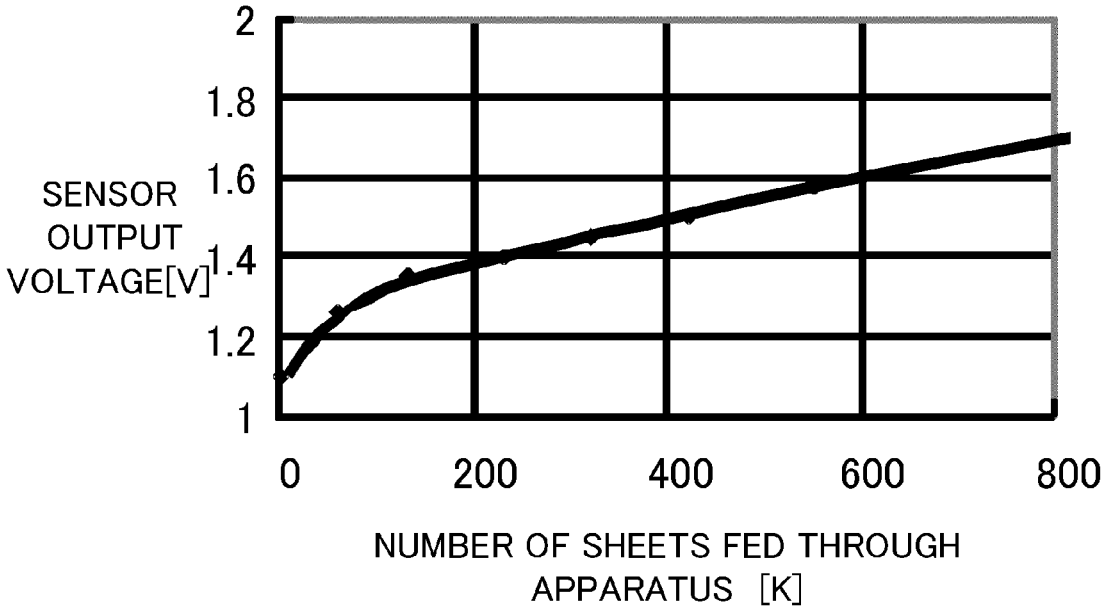
FIG. 5 is a graph showing the relationship between the number of recording paper sheets fed through the image forming apparatus to form an image with a coverage rate of 6% and the output voltage of the distance sensor.

Next, a description will be given of the relationship between the number of recording paper sheets fed through the image forming apparatus and the output voltage of the distance sensor. FIG. 5 is a graph showing the relationship between the number of recording paper sheets fed through the image forming apparatus to form an image with a coverage rate of 6% and the output voltage of the distance sensor. In the image forming apparatus 1, the bulk of toner fixed on the surface of the toner collecting member 81 increases with increasing number of recording paper sheets fed through the image forming apparatus 1. Therefore, as shown in FIG. 5, with increasing number of recording paper sheets fed through the image forming apparatus 1, the distance from the reference position to the surface of the toner collecting member 81 gradually decreases and the output voltage of the distance sensor 82 increases.

FIG. 6 is a table showing the occurrence/absence of unwanted toner spots on the image and the occurrence/absence of paper jam for different numbers of recording paper sheets fed through the image forming apparatus 1 in three different cases where three types of recording paper sheets, i.e., thin paper sheets of 50 g/m$^2$ (50-g sheets), standard paper sheets of 64 g/m$^2$ (64-g sheets), and thick paper sheets of 200 g/m$^2$ (200-g sheets), are fed through the image forming apparatus 1.

As indicated by "o" in column "JAM" of FIG. 6, neither unwanted toner spots on the image nor paper jam occurs for any type of recording paper sheet until the number of recording paper sheets fed through the image forming apparatus 1 reaches about 600K. However, as shown in columns "Unwanted Spots on Image" and "JAM" of FIG. 6, when the number of 50-g sheets fed through the image forming apparatus 1 reaches about 700K, unwanted toner spots on the image and a paper jam begin to occur. This can be attributed to the fact that when a thin paper sheet separates from the transfer belt 41, it tends to be attracted to the photosensitive drum 43 to come off the transfer belt 41 in its entirety, so that the subsequent trajectory of the paper sheet runs near the surface of the toner collecting member 81. On the other hand, when the number of 200-g sheets fed through the image forming apparatus 1 reaches about 700K, unwanted toner spots on the image begin to occur. This can be attributed to the fact that the trailing end of a thick paper sheet tends to jump up just after it has passed through the nip between the photosensitive drum 43 and the transfer roller 413, so that the subsequent trajectory of the trailing end thereof runs near the surface of the toner collecting member 81.

In view of the foregoing facts, it is preferred that when the number of recording paper sheets fed through the image forming apparatus 1 is, for example, over 600K, the user should be notified of the need to replace the toner collecting member 81. Furthermore, it is also preferred that when the number of recording paper sheets fed through the image forming apparatus 1 comes close to 600K, the user should be notified of the approach of the time to replace the toner collecting member 81. Therefore, the control section 100 determines whether or not the time to replace the toner collecting member 81 has come in the following manner.

Figure 7:
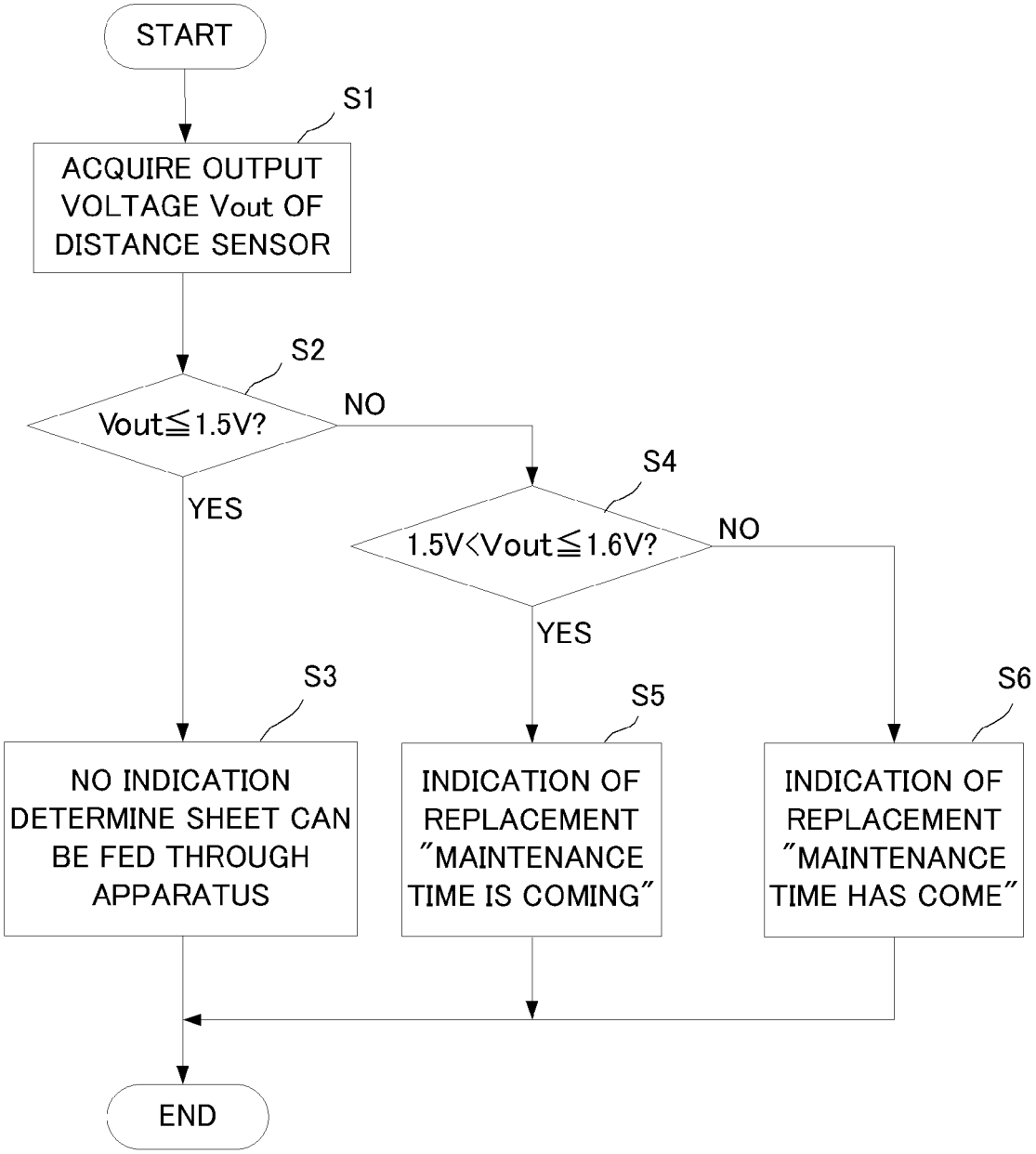
FIG. 7 is a flowchart of processing for determination on the time to replace a toner collecting member.

FIG. 7 is a flowchart of processing for determination on the time to replace the toner collecting member 81. Here, a description of the processing will be given by taking as an example the image forming apparatus 1 having the output voltage characteristics shown in FIGS. 4 and 5. The control section 100 acquires the output voltage Vout of the distance sensor 83 (S1). It will be good if the acquisition of Vout is done with a predetermined timing, such as at the start-up of the image forming apparatus 1 or around the time of printing operation.

If Vout is 1.5 V or less (YES in S2), the control section 100 determines that it should be allowed to feed a recording paper sheet through the image forming apparatus 1 and does not recognize an indication of the need to replace the toner collecting member 81 (S3) and then ends the processing for determination on the time to replace the toner collecting member 81. As seen from FIG. 5, when Vout is 1.5 V, the number of recording paper sheets fed through the image forming apparatus 1 is about 400K. Referring to FIG. 6, when the number of recording paper sheets fed through the image forming apparatus 1 is about 400K, any type of recording paper sheet causes neither unwanted toner spots on the image nor paper jam.

If Vout is greater than 1.5 V and not greater than 1.6 V (NO in S2 and YES in S4), the control section 100 determines that the time to replace the toner collecting member 81 is coming and allows the display 473 to display an indication of, for example, "MAINTENANCE TIME IS COMING" (S5) and ends the processing for determination on the time to replace the toner collecting member 81. As seen from FIG. 5, when Vout is 1.6 V, the number of recording paper sheets fed through the image forming apparatus 1 is about 600K. Referring again to FIG. 6, when the number of recording paper sheets fed through the image forming apparatus 1 is about 600K, a 50-g sheet and a 200-g sheet become likely to cause unwanted toner spots on the image or a paper jam.

If Vout is greater than 1.6 V (NO in S4), the control section 100 determines that the time to replace the toner collecting member 81 has come and allows the display 473 to display an indication of, for example, "MAINTENANCE TIME HAS COME" (S6) and ends the processing for determination on the time to replace the toner collecting member 81. The reason for this is that if Vout is greater than 1.6 V, it is very likely that a 50-g sheet and a 200-g sheet cause unwanted toner spots on the image or a paper jam.

As a solution to the above problems, the aforementioned technique is known in which a high-resistance, sheet-shaped transfer exit guide plate is provided downstream of the transfer belt in the direction of conveyance of the recording paper sheet to eliminate the static electricity of the recording paper sheet separated by curvature from the transfer belt using the guide plate and thus prevent separation discharge of the recording paper sheet. The high-resistance sheet member provided in this technique is effective as an inexpensive static eliminator and can reduce the occurrence of an image defect (electrostatically toner-scattered image) due to separation discharge upon separation of the recording paper sheet from the transfer belt. However, some separation discharge occurs, so that part of the toner on the recording paper sheet is scattered into the apparatus interior during the separation of the recording paper sheet. The toner scattered into the apparatus interior may be deposited thereon and contaminate the recording paper sheet upon vibration or the like of the apparatus components. Furthermore, in an image forming apparatus configured so that the nips in the transfer section and the fixing section are released in conjunction with the opening of the cover, deposited toner may fall on the conveyance path and so on upon opening of the cover and contaminate the recording paper sheet.

Unlike the above conventional image forming apparatuses, in the image forming apparatus 1 according to the one embodiment of the present disclosure, toner scattered during separation of the recording paper sheet from the transfer belt 41 is collected and fixed on the toner collecting member 81. Therefore, the recording paper sheet can be prevented from contamination due to the falling of toner scattered in and deposited on the apparatus interior.

The present disclosure is not limited to the above embodiment and can be modified in various ways. For example, although the description of the above embodiment is given taking a multifunction peripheral as an example of the image forming apparatus according to the present disclosure, the example is merely illustrative and the image forming apparatus may be any other electronic apparatus, for example, any other image forming apparatus, such as a printer, a copier or a facsimile machine.

The structure and processing shown in the above embodiment with reference to FIGS. 1 to 7 are merely illustrative of the present disclosure and not intended to limit the present disclosure to the above particular structure and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

a photosensitive drum having a surface on which a toner image is to be formed;

a transfer belt configured to be charged to an opposite polarity to the surface of the photosensitive drum to electrostatically attract a recording paper sheet and convey the recording paper sheet while pressing the recording paper sheet against the photosensitive drum, thereby transferring the toner image formed on the surface of the photosensitive drum to the recording paper sheet;

a fixing section configured to apply heat to the recording paper sheet having the toner image transferred thereto and thus fix the toner image on the recording paper sheet;

a toner collecting member disposed to face a separating position where the recording paper sheet is separated from the transfer belt and extending in a width direction of the recording paper sheet being conveyed, the toner collecting member being electrically grounded; and a thermally conductive member configured to collect heat near the fixing section and conduct the collected heat to the toner collecting member.

2. The image forming apparatus according to claim 1, wherein the toner collecting member is removable from a main body of the image forming apparatus, and the image forming apparatus further comprises:

a notifying section;

a distance sensor configured to detect a distance from a reference position to a surface of the toner collecting member; and a control section configured to determine whether or not a time to replace the toner collecting member has come according to the detected distance and, when determining that the time to replace the toner collecting member has come, allow the notifying section to notify a user of a message that the toner collecting member should be replaced.

3. The image forming apparatus according to claim 1, wherein the fixing section is configured to be heated by electromagnetic induction heating, and a portion of the thermally conductive member located near the fixing section is formed of a material containing a magnetic material.

4. The image forming apparatus according to claim 1, wherein a portion of the thermally conductive member is in contact with the toner collecting member.

5. The image forming apparatus according to claim 1, wherein during operation of the fixing section, the toner collecting member is heated above a glass transition point of toner used in the image forming apparatus.

* * * * *